US006516739B2

(12) United States Patent
Bartels et al.

(10) Patent No.: US 6,516,739 B2
(45) Date of Patent: Feb. 11, 2003

(54) WATERCRAFT

(75) Inventors: Jens-Erik Bartels, Heidenheim (DE); Harald Gross, Bolheim (DE); Dirk Jurgens, Heidenheim (DE)

(73) Assignee: Voith Schiffstechnik GmbH & Co. KG, Heidenheim (DE)

( * ) Notice: Subject to any disclaimer, the term of this patent is extended or adjusted under 35 U.S.C. 154(b) by 0 days.

(21) Appl. No.: 09/834,186

(22) Filed: Apr. 12, 2001

(65) Prior Publication Data

US 2001/0052313 A1 Dec. 20, 2001

(30) Foreign Application Priority Data

Apr. 14, 2000 (DE) ..... 100 18 573

(51) Int. Cl.[7] ..... B63H 25/06
(52) U.S. Cl. ..... 114/162; 114/242
(58) Field of Search ..... 114/162–169, 242, 114/246, 253; 440/90, 93, 79

(56) References Cited

U.S. PATENT DOCUMENTS

| | | | | | |
|---|---|---|---|---|---|
| 355,682 | A | * | 1/1887 | Cowles | 114/57 |
| 1,697,779 | A | * | 1/1929 | Roos | 114/162 |
| 2,524,184 | A | * | 10/1950 | Wiggins | 440/59 |
| 2,902,966 | A | * | 9/1959 | Baer | 114/253 |
| 3,473,504 | A | * | 10/1969 | Giddings | 114/162 |
| 3,977,352 | A | * | 8/1976 | Pran et al. | 114/235 R |
| 4,307,677 | A | * | 12/1981 | Jastram et al. | 114/167 |
| 4,434,739 | A | * | 3/1984 | Brix et al. | 114/162 |
| 5,575,230 | A | * | 11/1996 | Eronen | 114/56 |
| 5,896,016 | A | * | 4/1999 | Bayer | 318/68 |

FOREIGN PATENT DOCUMENTS

| | | | | |
|---|---|---|---|---|
| DE | 2504677 | * | 8/1976 | 144/166 |
| EP | 247273 | * | 12/1987 | 114/167 |
| FR | 1469014 | * | 2/1967 | 144/16 |
| GB | 374926 | * | 3/1931 | 440/79 |
| GB | 395336 | * | 10/1931 | 114/163 |
| JP | 63-116994 | * | 5/1988 | 440/79 |
| SU | 1583325 | * | 8/1990 | 114/162 |

OTHER PUBLICATIONS

Weiss et al, 'Das Manovrierkonzept der MOBIL JADE' (1980).

* cited by examiner

*Primary Examiner*—S. Joseph Morano
*Assistant Examiner*—Ajay Vasudeva
(74) *Attorney, Agent, or Firm*—Merchant & Gould P.C.

(57) ABSTRACT

A tugboat with a forwardly-facing rudder and roller at the stern, and a propulsion drive disposed at either the bow or the stem that generates a high transverse force for towing large ships on a desired course. The roller is disposed in an off-flow region aft of the rudder.

9 Claims, 1 Drawing Sheet

WATERCRAFT

The invention relates to a watercraft with a drive located in the bow region of the watercraft. It especially concerns watercraft with controllable drives. Such watercraft are also known as tugboats. The controllable drives can either be so-called rudder propellers or cycloidal propellers of the type of a so-called Voith-Schneider® propeller.

Such ships usually have a central rudder. It is located on the bulge in its longitudinal central plane, namely in the region relating to the longitudinal axis of the ship which is disposed at the other end than the drive.

Such ships are used as tugs or towing boats for maneuvering and escorting large freight ships, and tankers in particular. These ships are often called escort tugboats in fulfilling this task. During the escorting process the freight ship is in drive and the escorting tugboat is connected at the stern of the boat with the freight ship by way of a cable. If the rudder system and/or the main drive system fails in the freight ship, the escorting tugboat must produce large transverse forces in order to keep the large freight ship on the desired course. That is why it is necessary to produce the highest possible transverse force with the entire hull on the escorting tugboat.

In fulfilling the escorting task, the escorting tugboat is used with a rudder in such a way that the driving direction of the ship is such that the rudder faces forwardly. This driving direction is precisely opposite to the driving direction in other towing operations where the rudder faces backwardly.

The current state of high-performance rudder technology comprises transverse jet devices, propulsive thrust systems and special rudders with which maneuvering is already highly efficient The requirements have increased over time, however, so that further improvements are desirable.

The invention is therefore based on the object of providing a watercraft, and an escorting tugboat in particular, in such a way that the highest possible transverse forces are produced during the drive and that freight ships can be held securely on course. The object is to be achieved with a more minimal constructional effort as has been achieved with previously known means.

This object is achieved by the characterizing features of claim 1

The inventors have made use of an element which, although already know, is the rotatably held roller (cf. "Schiff & Hafen" [Ship & Harbor], No 4/1980). Such a rotatable roller is arranged on the rudder there, i.e., astern. According to the invention, however, such a rotating roller is arranged remote from the drive, i.e. in the region of the other end of the water craft, which differs from the location where the drive is situated. The idea is surprising in the respect that it must seem peculiar for the ship construction engineer According to the invention, the rotatable roller is arranged in the region of the rudder and there preferably at the end of the rudder which is remote from the drive. The rotatable roller is best arranged in the longitudinal central plane or at least parallel thereto. Its longitudinal axis extends either in the vertical direction or inclined against the vertical under a certain angle, e.g. 10, 20 or 30 degrees.

It is particularly appropriate to constructionally integrate the rotatable roller in such a way that the rotatable roller forms the edge of the rudder which is flowed against. The rudder assumes the bearing in this case.

The arrangement can be made in such a way that the rotatably held roller can be swiveled out of the longitudinal central plane about a vertical axis or about an axis which is slightly inclined with respect to the vertical. The roller can be swiveled out with its upper end by a different amount from the longitudinal central plane than with its lower end.

The rotatably held roller is provided with a drive. The roller can thus be made to rotate with a circumferential speed which amounts to a multiple of the ship's speed. The roller can be provided with a profiled surface, e.g. with elevations or recesses. The drive output is minimal. It is generally less than 50 kW.

The effect of the invention is surprising. It is possible to achieve considerable lifting forces with the rotatable roller, i.e. forces which emend perpendicularly to the flow and are disposed in the plane of the water surface. Tests have shown that the invention increases the lateral force of the watercraft by approx. 20%.

A control device is preferably associated with the rotatable roller. It is used to control the direction of rotation or the rotational speed of the roller or both the values.

Control can be effected in two ways: On the one hand, the control device can act depending on the transverse thrusting direction of the main driving system and/or optionally provided rudders, or on the other hand depending on the cable system, meaning in the direction of the cables. This can be understood as follows: The cable is generally guided between two posts which bear rolls for guiding the cable. The force can be detected in this process which is exerted by the cable on either the one or the other post. The control device can then control the rotational direction or the rotational speed of the roller, or both parameters, depending on the aforementioned control values.

With a minimum of constructional effort it is thus possible to substantially improve the lateral force of a watercraft as compared with previously known vehicles. This leads to the following advantages for the escorting task:

- the turning capabilities of the freight ship during maneuvering is minimized;
- the time until the performance of the turning maneuver is strongly reduced;
- the parallel displacement can be performed easily and quickly;
- the slow drive can be performed with ease even under difficult current conditions;
- shearing maneuvers can be initiated or completed without any major advance forces.

Numerous modifications of the invention are possible. The roller need not necessarily be circular-cylindrical. It can be provided with the shape of a cylinder with the cross section of a polygon, In addition, it needn't be cylindrical at all. Instead, it may be provided with a cross section which differs at different places of the length. As a result, it can be provided in the zone of the bulge with a circular cross section with a relatively large diameter and at the other end, averted from the bulge, with a circular cross section of a relatively small diameter, and may include a jacket surface that is profiled.

The invention will be generally employed in tugboats with two drives, of which one each is disposed on one side each of the longitudinal central plane. It is also possible to use the invention in a tugboat with only a single drive. It is also possible to provide two fins instead of one fin which are arranged parallel next to one another, with one each being on either side of the longitudinal central plane.

The invention is now explained in closer detail by reference to the enclosed drawing, which shows the following in detail:

Figure 1:
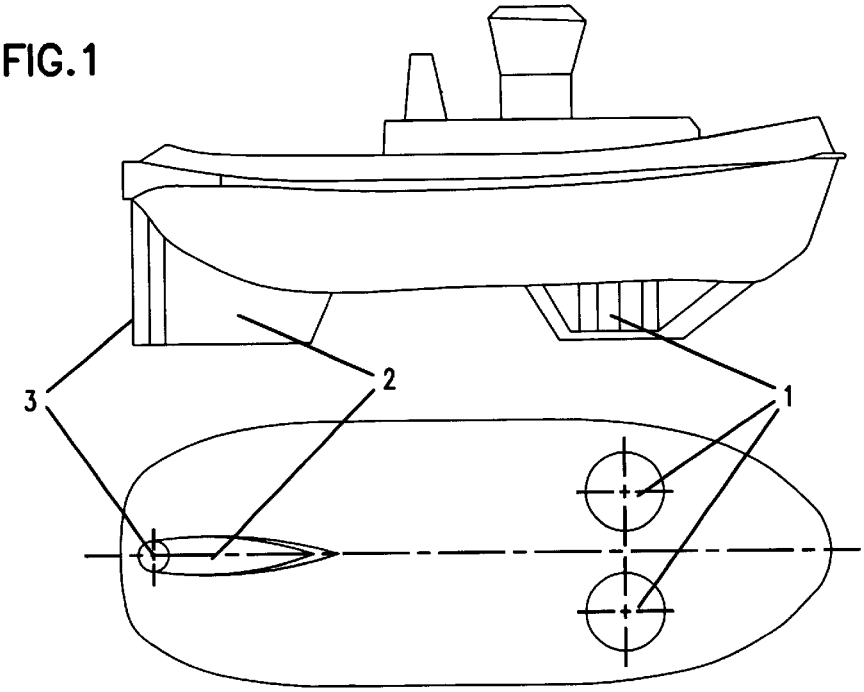
FIG. 1 shows an escorting tugboat with controllable drives.
Figure 2:
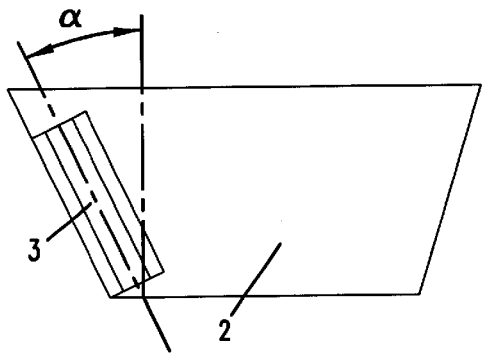
FIG. 2 shows an example rudder and roller inclined at an angle $\alpha$ with respect to vertical in accordance with the invention.
Figure 3:
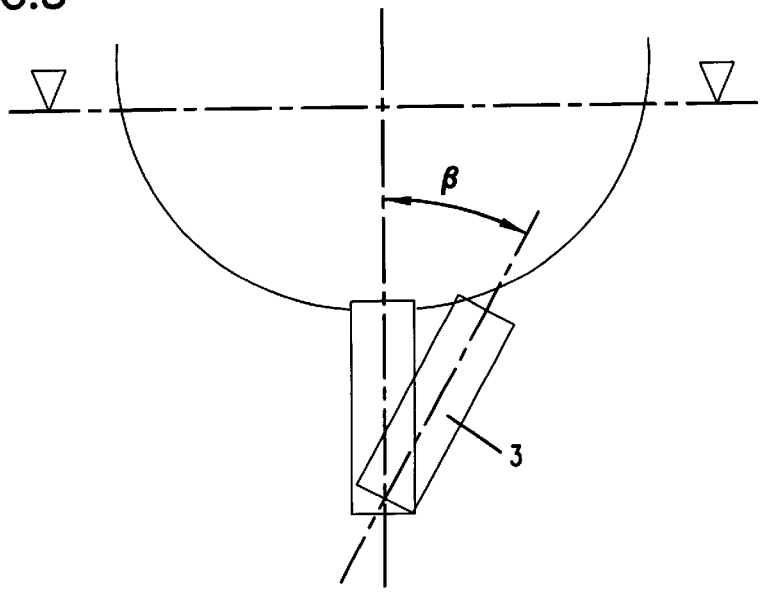
FIG. 3 shows one end of a tugboat including an example roller swiveled out of the longitudinal central plane at an angle $\beta$ in accordance with the present invention.

In the present case the two tugboat drivers are Voith-Schneider® propellers. Other types of drives can be considered instead.

What is claimed is:

1. A tugboat comprising;

1.1 a drive (1) which is disposed in a region of a bow of the tugboat;

1.2 a roller (3) being provided in a region of a stern of the tugboat, the roller being arranged perpendicularly and held rotatably about its longitudinal axis;

1.3 a roller drive being associated with the roller (3);

1.4 one or several rudders (2) being provided in a region of a central longitudinal plane or outside of a hull of the tugboat;

1.5 the roller (3) being disposed in an off-flow region behind the rudder (2).

2. A tug boat according to claim 1, wherein the roller (3) is inclined.

3. A tugboat according to claim 1, wherein the roller (3) is carried by the rudder (2).

4. A tugboat according to claim 1, wherein the roller (3) can be swiveled out of the longitudinal central plane.

5. A tugboat according to claim 4, wherein the roller (3) can be swiveled out wit its upper and by a different amount from the longitudinal central plane than with its lower end.

6. A tugboat according to claim 1, wherein a jacket surface of the roller (3) is profiled.

7. A tugboat according to claim 1, wherein the drive comprises a propulsion member which is controllable by 360°.

8. A tugboat according to claim 1, wherein the drive comprises a propulsion member controllable by 360° provided on either side of the longitudinal central plane of the tugboat.

9. A tugboat according to claim 1, wherein a control device is provided for controlling a direction of rotation and a rotational speed of the roller (3) depending on a force external to the roller (3).

* * * * *